US011002144B2

(12) United States Patent
Azad et al.

(10) Patent No.: US 11,002,144 B2
(45) Date of Patent: May 11, 2021

(54) SEALING ARRANGEMENT BETWEEN TURBINE SHROUD SEGMENTS

(71) Applicant: Siemens Aktiengesellschaft, Munich (DE)

(72) Inventors: Gm Salam Azad, Oviedo, FL (US); Runzhong Chen, Orlando, FL (US); Ching-Pang Lee, Cincinnati, OH (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/040,186

(22) PCT Filed: Mar. 30, 2018

(86) PCT No.: PCT/US2018/025311
§ 371 (c)(1),
(2) Date: Sep. 22, 2020

(87) PCT Pub. No.: WO2019/190541
PCT Pub. Date: Oct. 3, 2019

(65) Prior Publication Data

US 2021/0010381 A1 Jan. 14, 2021

(51) Int. Cl.
*F01D 11/00* (2006.01)
*F01D 9/04* (2006.01)

(52) U.S. Cl.
CPC ..... *F01D 11/006* (2013.01); *F01D 11/005* (2013.01); *F01D 9/041* (2013.01); (Continued)

(58) Field of Classification Search
CPC .... F01D 11/005; F01D 11/008; F01D 11/006; F01D 9/041; F01D 11/08; F01D 9/04
See application file for complete search history.

(56) References Cited

U.S. PATENT DOCUMENTS 4,524,980 A * 6/1985 Lillibridge ..... F01D 11/008 277/641
4,767,260 A * 8/1988 Clevenger ..... F01D 9/041 415/115

(Continued)

FOREIGN PATENT DOCUMENTS

EP 1798380 A2 6/2007

OTHER PUBLICATIONS

PCT International Search Report and Written Opinion of International Searching Authority dated Nov. 29, 2018 corresponding to PCT International Application No. PCT/US2018/025311 filed Mar. 30, 2018.

*Primary Examiner* — Brian P Wolcott
*Assistant Examiner* — Behnoush Haghighian

(57) ABSTRACT

A shroud assembly for a turbine engine includes a seal for sealing a gap between a first mate face of a first shroud segment and a second mate face of a circumferentially adjacent second shroud segment. The seal is received in first and second slots formed respectively on the first and second mate faces. The first and second slots extend axially between a leading edge and a trailing edge of the respective shroud segment. The first slot is open at the leading and the trailing edges while the second slot is open at the leading edge and closed at the trailing edge. The seal has axially extending first and second sides which are receivable respectively within the first and second slots. The seal has an axial length substantially equal to tan axial length of the shroud segments and has a cutout on the second side at a trailing edge end of the seal.

11 Claims, 3 Drawing Sheets

(52) U.S. Cl.
CPC ..... *F01D 11/008* (2013.01); *F05D 2240/11* (2013.01); *F05D 2240/12* (2013.01); *F05D 2240/55* (2013.01)

(56) References Cited

U.S. PATENT DOCUMENTS

| | | | | |
|---|---|---|---|---|
| 5,226,784 | A * | 7/1993 | Mueller | F01D 5/22 416/248 |
| 6,261,053 | B1 * | 7/2001 | Anderson | F01D 11/04 415/115 |
| 6,893,215 | B2 * | 5/2005 | Kuwabara | F01D 11/005 415/115 |
| 7,217,081 | B2 * | 5/2007 | Scheurlen | F01D 11/008 415/1 |
| 7,261,514 | B2 * | 8/2007 | London | F01D 5/225 415/134 |
| 7,316,402 | B2 * | 1/2008 | Paauwe | F01D 11/005 277/641 |
| 7,625,174 | B2 * | 12/2009 | Drerup | F01D 9/041 415/135 |
| 8,182,208 | B2 * | 5/2012 | Bridges, Jr. | F01D 11/005 415/139 |
| 9,255,488 | B2 * | 2/2016 | Szwedowicz | F16J 15/0887 |
| 9,581,036 | B2 * | 2/2017 | Pal | F01D 11/006 |
| 10,648,362 | B2 * | 5/2020 | Groves, II | F01D 11/003 |
| 2006/0263204 | A1 | 11/2006 | London et al. | |
| 2011/0182726 | A1 * | 7/2011 | McCaffrey | F01D 9/041 415/208.2 |
| 2013/0177383 | A1 * | 7/2013 | Winn | F01D 11/005 415/1 |
| 2018/0283193 | A1 * | 10/2018 | Walker | F16J 15/0806 |
| 2018/0340437 | A1 * | 11/2018 | Groves, II | F01D 11/005 |
| 2018/0355754 | A1 * | 12/2018 | Groves, II | F01D 11/005 |

* cited by examiner

SEALING ARRANGEMENT BETWEEN TURBINE SHROUD SEGMENTS

BACKGROUND

1. Field

The present invention relates to gas turbine engines, and in particular, to a sealing arrangement between circumferentially adjacent segments of a stationary shroud.

2. Description of the Related Art

A gas turbine engine includes a turbine section with one or more rows or stages of stationary vanes and rotor blades. The rotor blades include respective blade tips that run a tight gap with a stationary outer shroud assembly. Typically, the outer shroud assembly is an annular structure made up of a circumferential array of shroud segments. A sealing member may be provided to seal a gap between circumferentially adjacent shroud segments from the ingress of hot gases. The sealing member may be received in slots provided on the mate faces of circumferentially adjacent shroud segments. Manufacturing limitations and installation requirements may pose a challenge to the mechanical stability of the sealing arrangement at the operating conditions and/or the effectiveness of the seal to prevent leakage of hot gases during operation.

SUMMARY

Briefly, aspects of the present invention provide a sealing arrangement between turbine shroud segments that provides increased mechanical stability and leakage control.

According to a first aspect of the invention, a shroud for a turbine engine is provided. The shroud includes a first shroud segment having a first mate face and a second shroud segment having a second mate face. The first mate face is positioned circumferentially adjacent to the second mate face. The shroud further comprises a seal for sealing a gap between the first and second mate faces. The seal is received, at least in part, in a first slot formed on the first mate face and a second slot formed on the second mate face. The first and second slots extend axially between a leading edge and a trailing edge of the respective shroud segment, the first slot being open at the leading edge and at the trailing edge, the second slot being open at the leading edge and closed at the trailing edge. The seal comprises axially extending first and second sides which are receivable respectively within the first slot and the second slot. The seal has an axial length substantially equal to an axial length of the shroud segments and has a cutout on the second side at a trailing edge end of the seal.

According to a second aspect of the invention, a method for installing a shroud of a turbine engine is provided. The method comprises aligning a first shroud segment circumferentially adjacent to a second shroud segment such that a first mate face of the first shroud segment faces a second mate face of the second shroud segment. The first and second shroud segments are aligned such that an axially extending first slot on the first mate face is open at a leading edge and at a trailing edge of the first shroud segment, and that an axially extending second slot on the second mate face is open at a leading edge and closed at a trailing edge of the second shroud segment. The method further comprises inserting a seal into the first and second slots. The seal has axially extending first and second sides that are received within the first and second slots respectively during the installation. The seal has an axial length substantially equal to an axial length of the shroud segments, and has a cutout on the second side at a trailing edge end of the seal. A closed end of the second slot engages with a shoulder formed by the cutout on the second side of the seal to limit axial movement of the seal toward the trailing edge.

BRIEF DESCRIPTION OF THE DRAWINGS

The invention is shown in more detail by help of figures. The figures show specific configurations and do not limit the scope of the invention.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

In the following description, the terms "axial", "circumferential", "radial", and derivatives thereof, are defined in relation to a longitudinal turbine axis.

Figure 1:
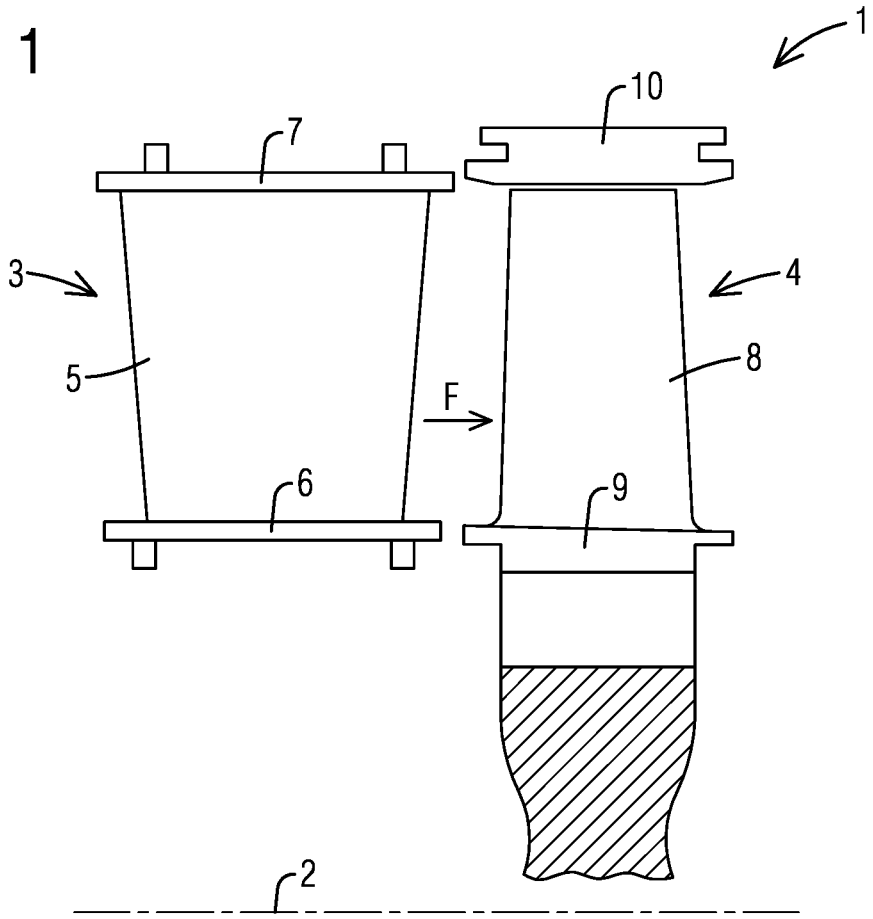
FIG. 1 is a longitudinal sectional view of a portion of a turbine section of a gas turbine engine.

Referring to FIG. 1 is illustrated a portion of a turbine stage 1 of a gas turbine engine. The turbine stage 1 is understood to be generally symmetrical in cross-sectional view about a longitudinal turbine axis 2. The turbine stage 1 includes a row of stationary vanes 3 and a row of rotor blades 4, which are mounted in annular formation around the turbine axis 2. The row of stationary vanes 3 includes an array of vane airfoils 5 extending radially into a flow path F of a working medium fluid. The vane airfoils 5 extend between an inner vane shroud 6 attached at a hub end and an outer vane shroud 7 attached at a tip end of the airfoils 5. The row of rotor blades 4 includes an array of blade airfoils 8 extending into the flow path F from a platform 9 attached at a hub end of the airfoils 8. The tip of the blade airfoils 8 run a tight gap with a stationary outer shroud 10, also referred to as a ring segment 10.

Figure 2:
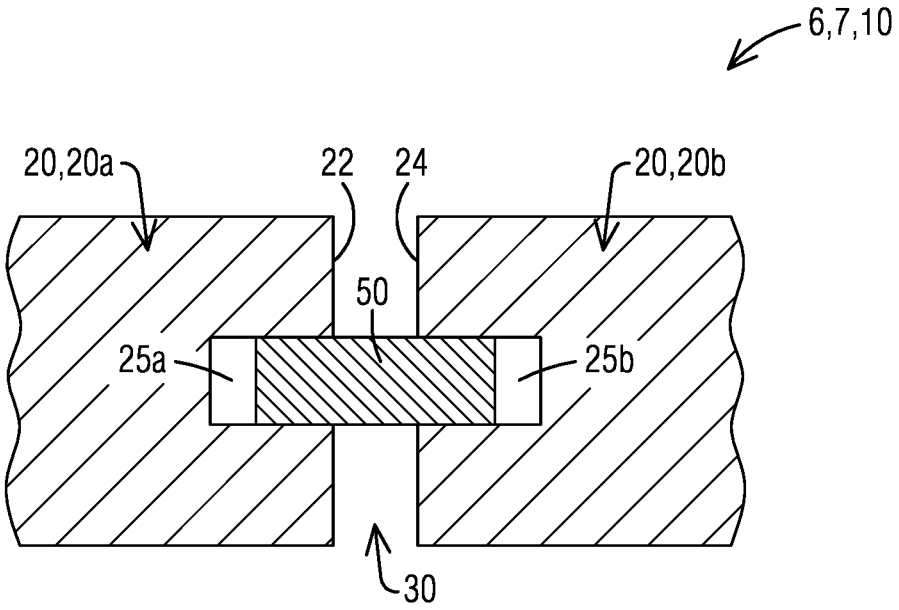
FIG. 2 is a schematic cross-sectional view, looking in an axial direction, of a segmented shroud.

The shrouds 6, 7 and 10 may each have an annular formation, being made up of multiple shroud segments arranged circumferentially side by side. An example configuration is shown in FIG. 2. In this example, a shroud, which may be any of the shrouds 6, 7, 10, is made up of a plurality of shroud segments 20. Two circumferentially adjacent shroud segments 20 are depicted in FIG. 2, namely a first shroud segment 20*a* and a second shroud segment 20*b*. The first shroud segment 20*a* has a first mate face 22 which is positioned adjacent to, and facing, a second mate face 24 of the second shroud segment 20*b*. A sealing member 50 (simply referred to as "seal 50" hereinafter) is provided for sealing a gap 30 between the first and second mate faces 22, 24. As shown, the seal 50 is received, at least in part, in a first slot 25*a* formed on the first mate face 22 and a second slot 25*b* formed on the second mate face 24. The seal 50 and the slots 25*a*, 25*b* extend axially (perpendicular to the plane of FIG. 2) between a leading edge and a trailing edge of the shroud segments 20*a*, 20*b* (not shown in FIG. 2)

In operation, a difference in pressure between the leading edge and the trailing edge of the shroud segments 20*a*, 20*b* may cause the seal 50 to be pushed toward the trailing edge, which may negatively affect the stability and effectiveness of the seal 50.

In one example configuration, particularly for a ring segment 10, the slots 25*a*, 25*b* extend axially all the way from the leading edge to the trailing edge of the respective shroud segments 20*a*, 20*b*. In this case, in order to keep the seal 50 inside the slots 25*a*, 25*b* during engine operation, a small cutout may be provided at a trailing edge corner of the seal 50. This cutout forms a cavity when the seal 50 is assembled inside the slots 25*a*, 25*b*. After the seal 50 is assembled in the slots, this cavity may be filled, for example, with a welding material. The seal 50 is thereby bonded in place at the trailing edge end to prevent movement during engine operation. However, the operational life of the welding material is typically shorter than that of the base material of the shroud segments 20*a*, 20*b*. In a scenario where welding material fails, it may potentially cause the seal 50 to slide out, partially or completely, from the trailing edge end of the shroud segments 20*a*, 20*b* and damage the downstream turbine components.

In an alternate configuration, particularly for a ring segment 10, the axial slots 25*a*, 25*b* may be closed at the leading edge and at the trailing edge of the shroud segments 20*a*, 20*b*. This design may not require a welding process. The seal 50 may be inserted into the slots 25*a*, 25*b* from a circumferential direction. In this case, the axial length of the seal 50 is shorter than the axial length of the shroud segments 20*a*, 2*b*, to ensure that the seal 50 fits into the closed slots 25*a*, 25*b*. The shorter seal length may result in gaps at the leading edge and at the trailing edge. The gaps may cause hot gas ingestion and increased cooling flow leakage, potentially resulting in performance degradation.

FIG. 3-6 illustrate an embodiment of the present invention which provides improved seal stability and leakage control. The present embodiments are illustrated in connection with a stationary outer shroud or ring segment 10 surrounding the tip of a row rotor blades in a turbine stage. However, aspects of the present invention may be applied to other types of segmented stationary shrouds, such as the inner vane shroud 6 and the outer vane shroud 7 shown in FIG. 1, among others.

Figure 3:
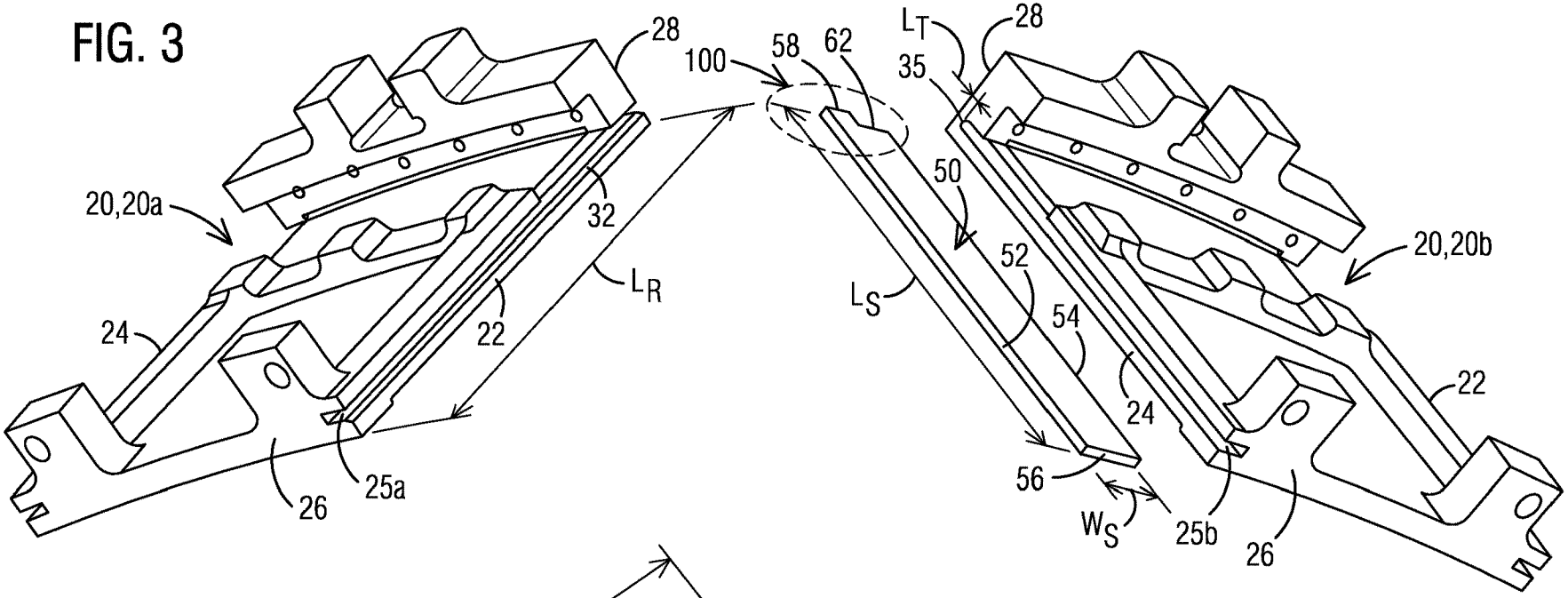
FIG. 3 is a fragmentary perspective view, illustrating components of an unassembled shroud, according to an embodiment of the present invention.
Figure 5:
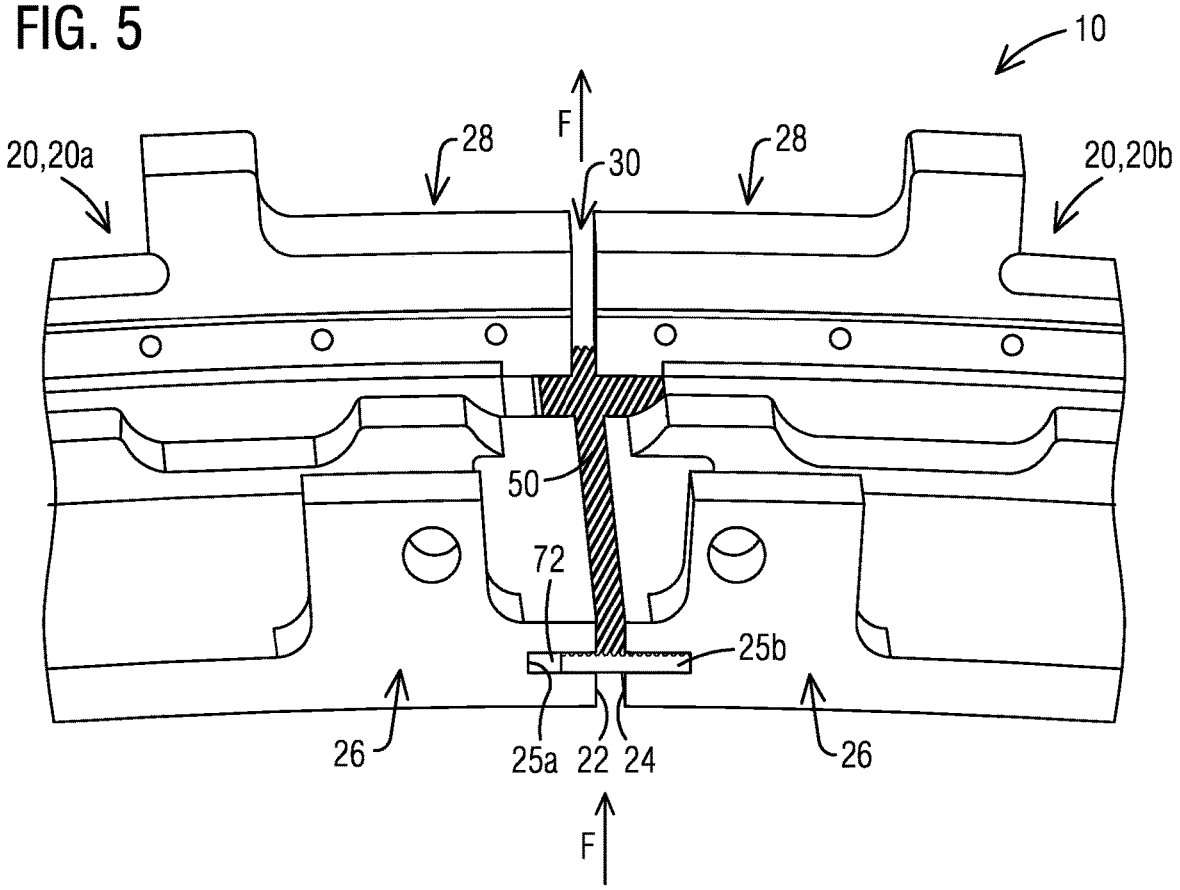
FIG. 5 is a perspective view of an assembled shroud according to said embodiment, looking in an axial direction in the direction of flow of a working medium fluid.
Figure 6:
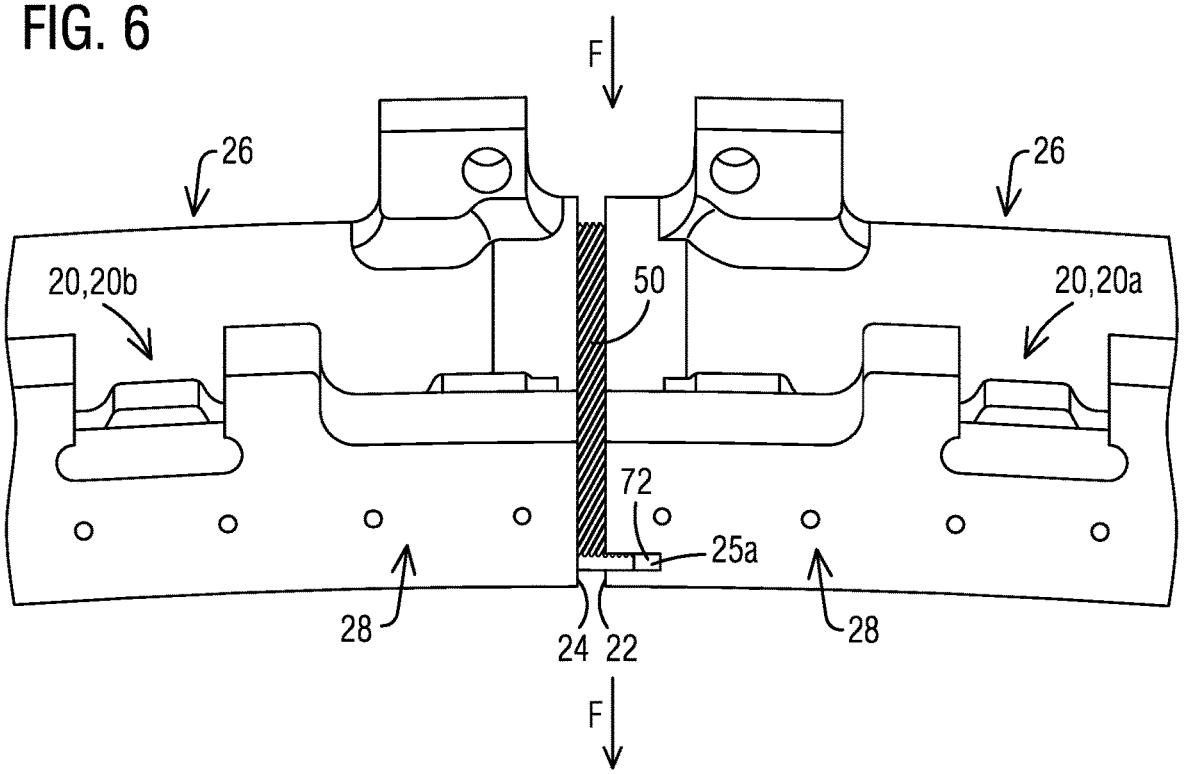
FIG. 6 is a perspective view of the assembled shroud according to said embodiment, looking in an axial direction against the direction of flow of the working medium fluid.

Referring to FIG. 3, an outer shroud 10 may be formed a number of shroud segments 20, two of which are depicted and identified as first and second shroud segments 20*a* and 20*b* respectively. Each shroud segment 20 extends axially from a respective leading edge 26 to a respective trailing edge 28. An axial length of the shroud segments 20 between the leading edge 26 and the trailing edge 28 is denoted as $L_R$ (the axial length $L_R$ of individual shroud segments 20*a*, 20*b* being substantially equal). Each shroud segment 20 further comprises a respective first mate face 22 and a respective second mate face 24, which extend axially from the leading edge 26 and the trailing edge 28. During assembly, the shroud segments 20*a*, 20*b* are aligned such that the first mate face 22 of the first shroud segment 20*a* is circumferentially adjacent to, and faces, the second mate face 24 of the second shroud segment 20*b*, as shown in FIG. 5 and FIG. 6. The assembly further includes a seal 50 for sealing a circumferential gap 30 between the first mate face 22 of the first shroud segment 20*a* and the second mate face 24 of the second shroud segment 20*b*.

Referring back to FIG. 3, the seal 50 has an axial length Ls which is substantially equal to the axial length $L_R$ of the shroud segments 20. The seal 50 is receivable in first and second slots 25*a*, 25*b* that are formed respectively on the first mate face 22 of the first shroud segment 20*a* and the second mate face 24 of the second shroud segment 20*b*. The first slot 25*a* extends along the entire axial length $L_R$ of the first shroud segment 20*a* from the leading edge 26 to the trailing edge 28. The first slot 25*a* is thereby open at the leading edge 26 and at the trailing edge 28. The second slot 25*b* extends axially from the leading edge 26 of the second shroud segment 20*b* but stops short of the trailing edge 28 of the second shroud segment 20*b*. The second slot 25*b* is thereby open at the leading edge 26 but closed at the trailing edge 28. The trailing edge end 35 of the second slot 25*b* is located at an axial distance $L_T$ from the trailing edge 28 of the second shroud segment 20*b*. Thus, the second slot 25*b* has a reduced axial length in relation to the first slot 25*a*.

It is to be understood that the first mate face 22 of the second shroud segment 20*b* may be configured similar to the first mate face 22 of the first shroud segment 20*a* in accordance with any of the embodiments described herein. Likewise, the second mate face 24 of the first shroud segment 20*a* may be configured similar to the second mate face 24 of the second shroud segment 20*b* in accordance with any of the embodiments described herein.

Figure 4:
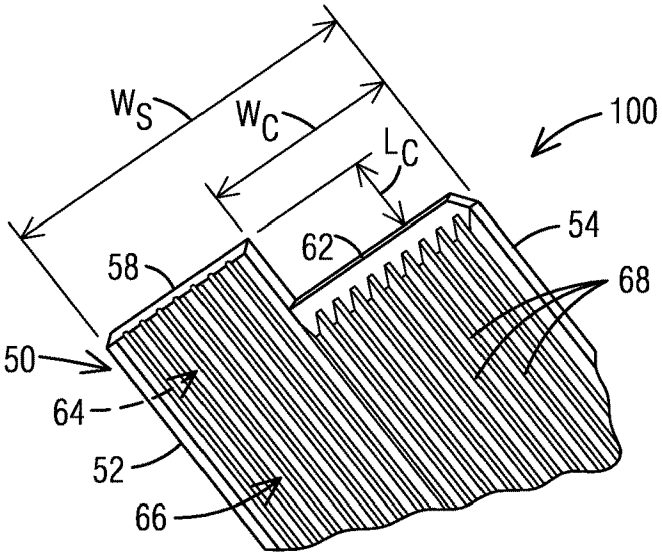
FIG. 4 is an enlarged perspective view of the portion 100 in FIG. 3.

The seal 50 comprises first and second sides 52, 54 which extend axially from a leading edge end 56 to a trailing edge end 58 of the seal 50. The first side 52 and the second side 54 of the seal 50 are receivable respectively within the first slot 25*a* and the second slot 25*b*. The first side 52 extends along the entire axial length Ls of the seal 50. The second side 54 has a cutout 60 at the trailing edge end 58. The second side 54 thereby has a shorter axial length than the first side 52. The cutout defines a shoulder 62 that is at an axial distance $L_C$ from the trailing edge end 58 of the seal 50, as shown in FIG. 4. The distance $L_C$ defines an axial length of the cutout 60.

In an exemplary assembly process, the seal 50 may be first be inserted tangentially into the slot 25*b* on the second mate face 24 of the second shroud segment 20*b* and then peen the seal 50 in the slot 25*b*. Thereafter, the seal 50 may be inserted into the slot 25*a* of the first mate face 22 of the first shroud segment 20*a* by sliding the shroud segment 20*a* on to the seal 50 tangentially. When inserted, the closed trailing edge end 35 of the second slot 25*b* engages with the shoulder 62 of the cutout 60 on the second side 54 of the seal 50, to limit axial movement of the seal 50 toward the trailing edge. In one embodiment, to guide the insertion, the first mate face 22 may comprise a chamfered portion 32 adjacent to the first slot 25*a* and extending along the axial length $L_R$ of the first shroud segment 20*a*, as shown in FIG. 3. The first side 52 and/or second side 54 of the seal 50 may also be chamfered along an axial extent thereof, to facilitate insertion of the seal 50.

In the illustrated embodiment, there is no requirement for a welding operation to keep the seal 50 in place. In this case, the closed end 35 of the second slot 35 forms a dam to prevent the seal 50 from sliding out of the slots 25*a*, 25*b* during engine operation. The dam, being made of the base material of the shroud segments 20, provides an improved operational life than a welding material. Furthermore, since the axial length Ls of the seal is substantially equal to the axial length $L_R$ of the shroud segments 20, it is ensured that no leakage gaps are formed at the leading edge 26 and at the trailing edge 28. Referring to FIGS. 5 and 6, a circumferential gap 72 may be provided in the slots 25*a*, 25*b* to allow thermal expansion of the seal 50.

The dam has a material thickness defined by the axial distance $L_T$ between the trailing edge end 35 of the second slot 25*b* and the trailing edge 28 of the second shroud segment 20*b*. In one embodiment, the axial length $L_C$ of the cutout 60 may be equal to or greater than the dam thickness $L_T$, to avoid formation of leakage gaps in the first slot 25*a* at the trailing edge 28. In a preferred embodiment, the axial length $L_C$ of the cutout 60 may be greater than dam thickness $L_T$ by no more than 0.5% of the axial length $L_R$ of the shroud segments 20, to avoid formation of leakage gaps at the leading edge 26 of the slots 25*a*, 25*b*.

Referring to FIG. 4, the seal 50 has a width Ws defined by a distance between the first side 52 and the second side 54 in the circumferential direction. The cutout 60 has a width $W_C$ defined by a width of the shoulder 62 in the circumferential direction. In the illustrated embodiment, the width $W_C$ of the cutout 60 is 40-60% of the width Ws of the seal 50.

Still referring to FIG. 4, the seal 50 has a first surface 64 adapted to face a hot gas path and a second surface 66 that would face away from the hot gas path during operation. In one embodiment, the seal 50 may be configured as a riffle seal, in which the second surface 66 is provided with a plurality of axial serrations 68, with the first surface 64 being smooth. A riffle seal with the above configuration may provide improved leakage resistance.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A shroud for a turbine engine, comprising:

a first shroud segment having a first mate face and a second shroud segment having a second mate face, the first mate face being positioned circumferentially adjacent to the second mate face, a seal for sealing a gap between the first and second mate faces, wherein the seal is received, at least in part, in a first slot formed on the first mate face and a second slot formed on the second mate face, wherein the first and second slots extend axially between a leading edge and a trailing edge of the respective shroud segment, the first slot being open at the leading edge and at the trailing edge, the second slot being open at the leading edge and closed at the trailing edge, wherein the seal comprises axially extending first and second sides which are receivable respectively within the first slot and the second slot, the seal having an axial length substantially equal to an axial length of the shroud segments and having a cutout on the second side at a trailing edge end of the seal.

2. The shroud according to claim 1, wherein an axial length of the cutout is equal to or greater than an axial thickness between a trailing edge end of the second slot and the trailing edge of the second shroud segment.

3. The shroud, according to claim 2, wherein the axial length of the cutout is greater than the axial thickness between the trailing edge end of the second slot and the trailing edge of the second shroud segment by no more than 0.5% of the axial length of the shroud segments.

4. The shroud according to claim 1, wherein a width of the cutout is 40-60% of a width of the seal.

5. The shroud according to claim 1, wherein the seal is a riffle seal comprising a first surface facing a hot gas path and a second surface facing away from the hot gas path, wherein the first surface is smooth and the second surface comprises a plurality of serrations extending in the axial direction.

6. The shroud according to claim 1, wherein the first mate face comprises a chamfered portion adjacent to the first slot and extending along the axial length of the first shroud segment.

7. The shroud according to claim 1, wherein the first side and/or second side of the seal are chamfered along an axial extent thereof.

8. The shroud according to claim 1, wherein the shroud defines a stationary ring segment positioned radially outward of a row of rotor blades.

9. The shroud according to claim 1, wherein the shroud defines an outer vane shroud attached to a tip end of a row of stationary vanes.

10. The shroud according to claim 1, wherein the shroud defines an inner vane shroud attached to a hub end of a row of stationary vanes.

11. A method for installing a shroud of a turbine engine, comprising:

aligning a first shroud segment circumferentially adjacent to a second shroud segment such that a first mate face of the first shroud segment faces a second mate face of the second shroud segment, the first and second shroud segments being aligned such that:

an axially extending first slot on the first mate face is open at a leading edge and at a trailing edge of the first shroud segment, and an axially extending second slot on the second mate face is open at a leading edge and closed at a trailing edge of the second shroud segment, and inserting a seal into the first and second slots, the seal having axially extending first and second sides that are received within the first and second slots respectively during the installation, the seal having an axial length substantially equal to an axial length of the shroud segments and having a cutout on the second side at a trailing edge end of the seal, whereby a closed trailing edge end of the second slot engages with a shoulder formed by the cutout on the second side of the seal, to limit axial movement of the seal toward the trailing edge.

* * * * *